United States Patent [19]

Sung et al.

[11] 4,420,407

[45] Dec. 13, 1983

[54] METHOD OF LUBRICATING UPPER CYLINDER OF MARINE DIESEL ENGINE

[75] Inventors: Rodney L. Sung, Fishkill; Benjamin H. Zoleski, Beacon; William P. Cullen, Fishkill; Mahmoud S. Kablaoui, Wappingers Falls, all of N.Y.

[73] Assignee: Texaco Inc., White Plains, N.Y.

[21] Appl. No.: 313,564

[22] Filed: Oct. 22, 1981

[51] Int. Cl.[3] ..... C10M 1/40

[52] U.S. Cl. ..... 252/33.4

[58] Field of Search ..... 252/33.4, 51.5 A

[56] References Cited

U.S. PATENT DOCUMENTS

| | | | |
|---|---|---|---|
| 3,272,743 | 9/1966 | Norman et al. | 252/33.4 X |
| 3,390,083 | 6/1968 | Lion | 252/56 R X |
| 3,753,905 | 8/1973 | Souillard et al. | 252/33.4 |
| 3,879,306 | 4/1975 | Kablaoui et al. | 252/51.5 A |
| 4,048,080 | 9/1977 | Lee et al. | 252/51.5 A |
| 4,098,585 | 7/1978 | Vartanian et al. | 252/51.5 A X |
| 4,159,956 | 7/1979 | de Vries | 252/33.4 |

OTHER PUBLICATIONS

Hori et al., "Spreadability of Marine Diesel Engine Cyl. Oils on a Glass Surface at High Temperatures", Lub. Eng., vol. 33, 2, pp. 83–90, 1977.

*Primary Examiner*—Andrew Metz

*Attorney, Agent, or Firm*—Robert A. Kulason; James J. O'Loughlin; Martin M. Glazer

[57] ABSTRACT

A cylinder lubricating oil composition characterized by having a Total Base Number from about 50 to 100 comprising a mineral lubricating oil, from 10 to 20 percent of an overbased calcium sulfonate and an N-hydroxyethyl alkenylsuccinimide represented by the formula:

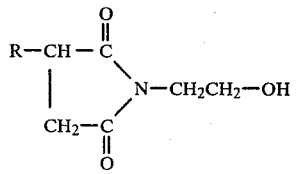

in which R is a straight chain hydrocarbon radical having form about 8 to 22 carbon atoms.

3 Claims, No Drawings

METHOD OF LUBRICATING UPPER CYLINDER OF MARINE DIESEL ENGINE

BACKGROUND OF THE INVENTION

1. Field of the Invention

Energy costs, particularly as illustrated by the cost of crude oil and liquid petroleum distillates derived from crude oil have escalated rapidly. These costs are especially burdensome to the users of transportation fuels, such as shipowners, and these major consumers of petroleum products are reacting to these events and are searching for more efficient measures to use in their operations. One significant development in the shipping field is the trend away from steam turbine propulsion units in favor of large marine diesel engines which are more fuel efficient with respect to petroleum fuels.

The largest marine diesel engines used for ship propulsion are classified as slow speed marine diesel engines. These engines are unique both in their size and in their method of operation. The engines themselves are massive, the larger units approaching 2000 tons in weight and upwards of 100 feet long and 45 feet in height. Their output can reach 50,000 brake horsepower with engine revolutions ranging from about 100 to 125 revolutions per minute.

The slow speed marine diesel engines are also unique in their design. Most notably, the crankcase of the large slow speed single acting 2-stroke crosshead type of engine is completely separate from the combustion chambers of the engine. Because of this, its lubrication requirement differs from that of a typical diesel engine. In particular, the upper cylinder portion of the slow speed diesel engine, not being in direct communication with the crankcase zone of the engine, has it own lubrication system with specific lubrication requirements that differ markedly from the requirements of a crankcase lubricant. In addition, and for reasons of economy, the fuel employed to run the large slow speed diesel engines are residual fuels having relatively high levels of sulfur. This circumstance dictates the employment of a highly overbased lubricating oil composition in order to counteract the acidity generated during the combustion of the sulfur-containing fuel. As a result, a typical cylinder lubricating oil composition for a slow speed marine diesel engine will have an alkalinity level expressed as total base number ranging between about 50 and 100.

The fuel consumption rate of a marine diesel engine of 30,000 horsepower ranges upwards of 1200 gallons of fuel per hour. In view of the current need to reduce overall oil consumption, intensive efforts are being made to discover lubricating oil compositions which can materially reduce the friction losses which take place within the engine itself. Reductions in engine friction losses translate directly into significant fuel savings.

Numerous means have been employed to reduce the friction in internal combustion engines. These range from the use of lower viscosity lubricating oils or mixtures of mineral and synthetic lubricating oils as well as to the incorporation of friction-reducing additives such as graphite, molybdenum compounds and other chemical additives. There are limits to the extent to which the viscosity of a lubricating oil can be reduced for the purpose of reducing friction. Generally, a lubricating oil having too light a viscosity will fail to prevent metal-to-metal contact during high load operating conditions with the result that unacceptable wear will occur in the engine. With respect to chemical anti-friction additives, significant research efforts are ongoing to find effective and economic anti-friction additives which exhibit stability over an extended service life and under a wide range of operating conditions.

It is an object of this invention to provide a novel cylinder lubricating oil composition for a slow speed marine diesel engine.

It is another object of this invention to provide a highly overbased marine cylinder lubricating oil having improved friction properties for lubricating a slow speed marine diesel engine.

2. Description of the Prior Art

U.S. Pat. No. 3,779,920 and 4,131,551 disclose overbased calcium sulfonates and their use in lubricating oil compositions.

U.S. Pat. No. 3,879,306 discloses the use of an N-hydroxyethyl succinimide as a friction modifier in an automatic transmission fluid.

The disclosures of all of the U.S. patents noted here are incorporated herein by reference.

SUMMARY OF THE INVENTION

The cylinder lubricating oil composition of this invention comprises a lubricating oil, an overbased calcium sulfonate having a Total Base Number from 300 to 450 in an amount sufficient to impart a total base number ranging from about 50 to 100 to the lubricating oil composition and a minor amount of an N-hydroxyethyl alkenylsuccinimide represented by the formula:

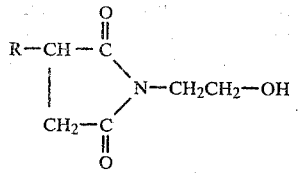

in which R is a straight chain hydrocarbon radical having from about 8 to 22 carbon atoms.

The novel method of the invention involves operating a slow speed marine diesel engine by supplying the above-described lubricating oil composition to the upper cylinder lubrication system of said engine.

SPECIFIC EMBODIMENTS OF THE INVENTION

In a more specific embodiment of the invention, the cylinder lubricating composition of the invention will comprise at least 80 weight percent of a mineral lubricating oil, from about 10 to 20 weight percent of an overbased calcium sulfonate sufficient to impart a total base number to the lubricating oil composition ranging between about 50 and 100 and a minor friction modifying amount of an N-hydroxyethyl alkenylsuccinimide represented by the formula:

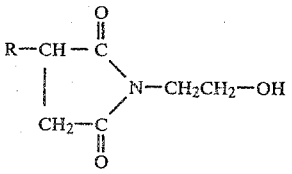

in which R is a straight chain hydrocarbon radical having from about 8 to 22 carbon atoms.

A preferred friction modifying component of the lubricating oil composition of the invention is one in which R is a straight chain monovalent hydrocarbon radical having from about 12 to 18 carbon atoms. A particularly effective compound is one in which R has about 12 carbon atoms.

The structure of the alkenyl radical on the N-hydroxyethyl alkenylsuccinimide is critical to the performance of the cylinder lubricating oil composition of this invention. It is believed that a straight chain alkenyl radical on a succinimide is less soluble in the oil substrate than a branched-chain radical is and that the reduced solubility of the straight-chain hydroxyethyl alkenylsuccinimide causes different surface or boundary layer phenomenom that promotes reduced friction in the novel cylinder lubricant and method of the invention.

Methods for preparing hydroxyethyl alkenylsuccinimide are well known in the art and do not constitute a part of this invention.

The friction modifying component of the cylinder lubricating oil composition of the invention is effective in a range from about 0.2 to 5 weight percent based on the total lubricating oil composition. In general, it is preferred to employ from about 0.5 to 2 weight percent of the prescribed N-hydroxyethyl alkenylsuccinimide with the most preferred concentration ranging from about 0.75 to 1.5 weight percent.

A second essential component of the cylinder lubricating oil composition of the invention is an overbased calcium sulfonate having a Total Base Number ranging from 300 to 450 on an active material or neat basis. This component is employed in the finished cyclinder lubricating oil at a concentration ranging from 10 to 20 weight percent based on the weight of the lubricating oil composition and sufficient to provide a cylinder lubricating oil having a Total Base Number from about 50 to 100. A preferred overbased calcium sulfonate has a TBN ranging from about 350 to 425, a preferred concentration of the sulfonate in the lubricating oil is from about 12 to 18 weight percent and a preferred TBN for the lubricating oil composition is from 60 to 80. Total Base Number (TBN) is a measure of alkalinity determined according to the test procedure outlined in ASTM D-664.

Overbased calcium sulfonates can be derived from sulfonic acids or particularly from petroleum sulfonic acids or alkylated benzene sulfonic acids. Useful sulfonic acids from which the overbased calcium sulfonates are prepared can have from about 12 to 200 carbon atoms per molecule. Examples of specific sulfonic acids include mahogany sulfonic acid, petrolatum sulfonic acids, aliphatic sulfonic acids and cycloaliphatic sulfonic acids. Particularly useful alkylated benzene sulfonic acids include polybutylbenzene sulfonic acid, polypropylbenzene sulfonic acid and copolymer propyl 1-butylbenzene sulfonic acids having molecular weights ranging from about 400 to about 900.

The overbased calcium sulfonates are produced by neutralizing the sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water. Methods for preparing overbased calcium sulfonates are disclosed in U.S. Pat. Nos. 3,779,920 and 4,131,551 and the disclosures in these references are incorporated herein by reference.

The hydrocarbon base oil which can be employed to prepare the cylinder lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 50 and 1500, preferably between about 100 and 1200, are normally employed for the lubricant composition. The most preferred lubricating viscosity for a cylinder lubricating oil composition is a viscosity ranging from about 68 to 108 SUS at 210° F. The hydrocarbon oil will generally constitute from about 80 to 90 weight percent of the total lubricating oil composition with the preferred concentration range being from about 82 to about 88 weight percent.

The improvement in fuel economy brought about by the novel cylinder lubricant composition of the invention was demonstrated in the Small Engine Friction Test. The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart charges of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results were recorded compared to a reference band consisting of data from up to three reference runs made before and three runs made after the test oil evaluation.

The frictional effects of the novel cylinder lubricating oil composition of the invention containing the prescribed N-hydroxyethyl alkenylsuccinimide friction modifier was evaluated in a commercial marine cylinder lubricating oil composition. The commercial lubricant or base oil and the modified oil containing the friction modifier of the invention were tested for the friction properties in the Small Engine Friction Test described above. The oil compositions and the test results are set forth in the table below:

TABLE I

SMALL ENGINE FRICTION TEST RESULTS OF 70 TBN MARINE CYLINDER OIL

| | Marine Cylinder Oil (Base Oil) L-480-7206.00 (Taro Special) | Modified Marine Cylinder Oil L-580-7209.00 |
|---|---|---|
| Composition, Vol. % | | |
| Solvent Neutral Oil - SUS at 100° F. of 845 | 38.338 | 37.338 |
| Bright Stock 145, | 16.300 | 16.300 |

TABLE I-continued

SMALL ENGINE FRICTION TEST RESULTS OF 70 TBN MARINE CYLINDER OIL

| | Marine Cylinder Oil (Base Oil) L-480-7206.00 (Taro Special) | Modified Marine Cylinder Oil L-580-7209.00 |
|---|---|---|
| 135-145 SUS at 212° F. 75/80 Pale Oil, 70-77 SUS at 212° F. | 31.550 | 31.550 |
| Overbased calcium sulfonate 400 TBN | 13.800 | 13.800 |
| Corrosion Inhibitor | 0.012 | 0.012 |
| Silicone Antifoamant, ppm | 150 | 150 |
| N—(2-hydroxyethyl)-n-tetradecenylsuccinimide | — | 1.000 |
| | 100.000 | 100.000 |
| Engine Motoring Torque, Ft. Lbs. at 280° F. | 3.20 | 2.87 |
| Frictional Improvement, % | — | 10.3 |

The foregoing example demonstrates the realization of a 10.3 percent reduction in the frictional properties of a 70 TBN marine cylinder oil due to the presence of an N-(2-hydroxyethyl) alkenylsuccinimide friction modifier. This invention provides an unexpected improvement in the frictional properties of a highly overbased marine cylinder lubricating oil composition for a large slow speed diesel engine.

We claim:

1. A method for lubricating the upper cylinder zone of a slow speed marine diesel engine wherein the fuel employed is a high sulfur residual fuel oil which continuously generates acidity which comprises injecting into the upper cylinder zone of said engine a lubricating oil composition having a Total Base Number in the range from about 50–100 comprising a mineral lubricating oil, from about 10–20 wt % of an overbased calcium sulfonate having a Total Base Number from about 300–450, and a friction modifying amount of an N-hydroxyethyl alkenylsuccinimide represented by the following formula:

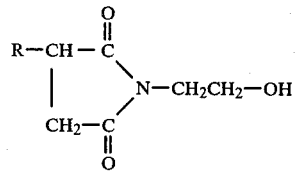

in which R is a straight chain hydrocarbon radical having from about 12 to 18 carbon atoms.

2. A method according to claim 1 in which the R in said N-hydroxyethyl alkenylsuccinimide is an N-tetradecenyl radical.

3. A method according to claim 1 containing from about 12 to 18% of an overbased calcium sulfonate having a Total Base Number ranging from 350 to 425.

* * * * *